United States Patent [19]

Wexler

[11] Patent Number: 4,830,364

[45] Date of Patent: May 16, 1989

[54] INTERACTIVE BATON AND DUMBBELL TYPE AMUSEMENT DEVICE

[76] Inventor: Howard Wexler, 300 E. 40th St., New York, N.Y. 10016

[21] Appl. No.: 56,594

[22] Filed: Jun. 1, 1987

[51] Int. Cl.[4] ..... A63B 13/00; A63B 65/00

[52] U.S. Cl. ..... 272/93; 273/428; 446/240

[58] Field of Search ..... 272/128, 93, 122, 123, 272/106, 1 R; 84/477 B; 273/83, 84 R, 26 R, 1 R, 428; 446/266, 240, 75, 489; 135/75

[56] References Cited

U.S. PATENT DOCUMENTS

| | | | |
|---|---|---|---|
| 401,061 | 4/1889 | Pilon et al. | 135/75 |
| 1,909,932 | 5/1933 | Digel | 273/84 R |
| 2,364,137 | 12/1944 | Gibb | 273/428 |
| 2,527,906 | 10/1950 | Bennett et al. | 273/26 R |
| 3,069,804 | 12/1962 | Cirafesi | 446/266 |
| 3,528,659 | 9/1970 | Benham | 273/428 |
| 3,762,704 | 10/1973 | Gingras | 272/75 |

*Primary Examiner*—Richard J. Apley
*Assistant Examiner*—S. R. Crow
*Attorney, Agent, or Firm*—Peter L. Berger

[57] ABSTRACT

An amusement device is comprised of a dumbbell arrangement including a first thin semi-spherical half shell having a first open end, a second thin semi-spherical half shell having a second open end, a first foam filler material secured in the first half shell and extending partially out of the first open end to define a first non-skid playing surface, a second foam filler material secured in the second half shell and extending partially out of the second open end to define a second non-skid playing surface, and a telescoping connecting shaft connecting the first and second half shells, the shaft extending through the first and second filler materials and having opposite ends for connecting the first and second half shells, respectively, the shaft having a length sufficient to separate the first and second half shells in spaced apart relation with the first and second playing surfaces in spaced, opposing relation and to collapse the dumbbell arrangement into a ball configuration; and a baton for twirling the dumbbell arrangement, the baton having opposite ends, one of which is capable of being grasped by a person and the other of which is capable of engaging against the first and second non-skid playing surfaces to twirl the dumbbell arrangement, the baton being capable of storage in the passages in the first and second filler materials when the dumbbell arrangement is collapsed.

10 Claims, 3 Drawing Sheets

INTERACTIVE BATON AND DUMBBELL TYPE AMUSEMENT DEVICE

BACKGROUND OF THE INVENTION

This invention relates generally to amusement devices, and more particularly, is directed to an amusement device that can be thrown, twirled and the like.

Amusement devices that can be thrown, twirled and the like are well known. Such devices take many varied forms, and have different levels of dexterity in use.

One problem with such devices is that they can be relatively bulky for carrying and storage. This is because the form that the devices take in use is also the form that they take for storage. This problem is increased further when the amusement device includes more than one element.

OBJECTS AND SUMMARY OF THE INVENTION

Accordingly, it is an object of the present invention to provide an amusement device that overcomes the aforementioned problems.

It is another object of the present invention to provide an amusement device including a dumbbell arrangement that can be twirled by a baton.

It is still another object of the present invention to provide an amusement device in which the dumbbell arrangement has non-skid surfaces against which the baton engages.

It is yet another object of the present invention to provide an amusement device in which the baton can be stored in the dumbbell arrangement.

It is a further object of the present invention to provide an amusement device in which the dumbbell arrangement can be collapsed into a ball for carrying and storage.

It is a still further object of the present invention to provide an amusement device in which the baton can be stored in the dumbbell arrangement during collapsing of the same.

In accordance with an aspect of the present invention, an amusement device is comprised of a dumbbell arrangement including a first thin half shell having a first open end, a second thin half shell having a second open end, a first filler material secured in the first half shell and extending partially out of the first open end to define a first non-skid playing surface, a second filler material secured in the second half shell and extending partially out of the second open end to define a second non-skid playing surface, and connecting shaft means for connecting the first and second half shells, the shaft means extending through the first and second filler materials and having opposite ends for connecting the first and second half shell, respectively, the shaft means having a length sufficient to separate the first and second half shells in spaced apart relation with the first and second playing surfaces in spaced, opposing relation; and baton means for twirling the dumbbell arrangement, the baton means having opposite ends, one of which is capable of being grasped by a person and the other of which is capable of engaging against the first and second non-skid playing surfaces to twirl the dumbbell arrangement.

In accordance with another aspect of the present invention, an amusement device is comprised of a dumbbell arrangement including a first thin semi-spherical half shell having a first open end, a second thin semi-spherical half shell having a second open end, a first filler material secured in the first half shell and extending partially out of the first open end to define a first non-skid playing surface, a second filler material secured in the second half shell and extending partially out of the second open end to define a second non-skid playing surface, the first and second filler materials each have a passage therein, and connecting shaft means for connecting the first and second half shells, the shaft means extending through the first and second filler materials and having opposite ends for connecting the first and second half shells, respectively, the shaft means including a plurality of telescopically connected shaft portions, one of the shaft portions including one end of the shaft means which is connected to the first half shell and another one of the shaft portions including the opposite end of the shaft means which is connected to the second half shell, the shaft portions having lengths in an extended position which are sufficient to separate the first and second half shells in spaced apart relation with the first and second playing surfaces in spaced, opposing relation, and in a collapsed position which provide that the first and second non-skid playing surfaces are in contact so as to form the dumbbell arrangement in a collapsed ball configuration; and baton means for twirling the dumbbell arrangement, the baton means having opposite ends, one of which is capable of being grasped by a person and the other of which is capable of engaging against the first and second non-skid playing surfaces to twirl the dumbbell arrangement, the baton means including a plurality of telescopically connected baton sections wherein the baton means can be collapsed to fit within the passages when the dumbbell arrangement is in the collapsed ball configuration.

The above and other objects, features and advantages of the present invention will become readily apparent from the following detailed description which is to be read in connection with the accompanying drawings.

DETAILED DESCRIPTION OF THE PREFERRED EMBODIMENTS

Figure 1:
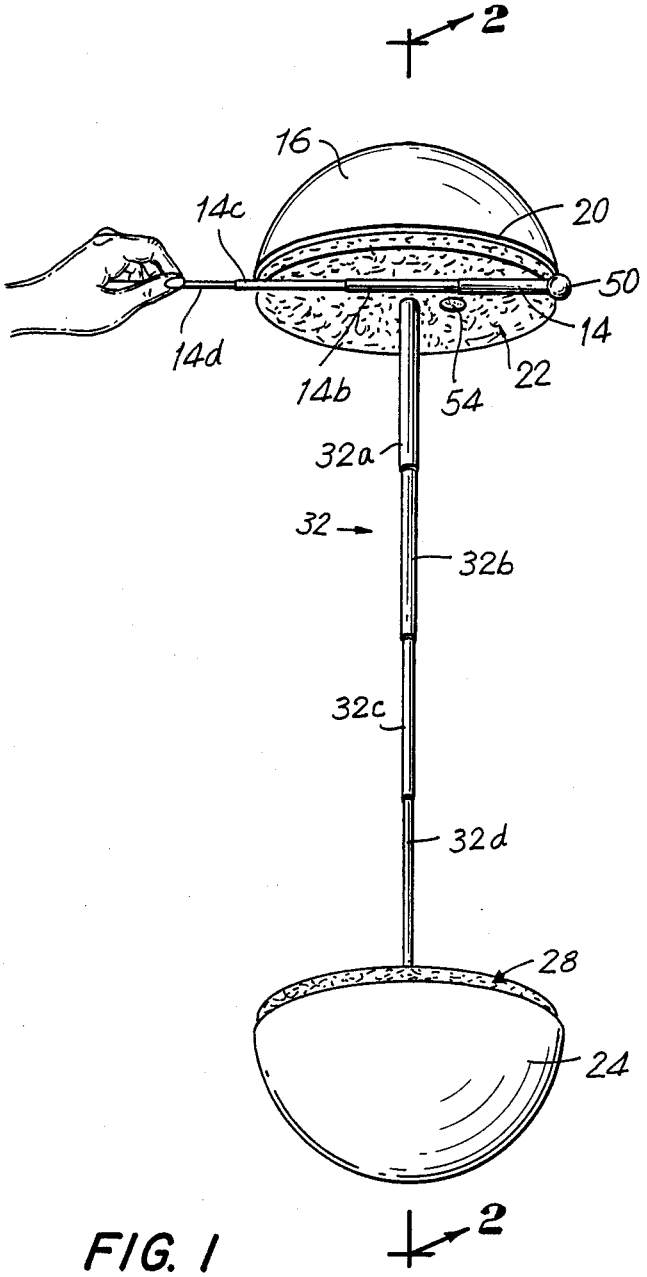
FIG. 1 is a perspective view of the amusement device according to one embodiment of the present invention, in use.

Referring to the drawings in detail, and initially to FIG. 1 thereof, an amusement device 10 according to the present invention generally includes a dumbbell arrangement 12 that is intended to be thrown, twirled and the like, and a baton 14 for interacting with dumbbell arrangement 12 to throw and twirl the same.

Figure 2:
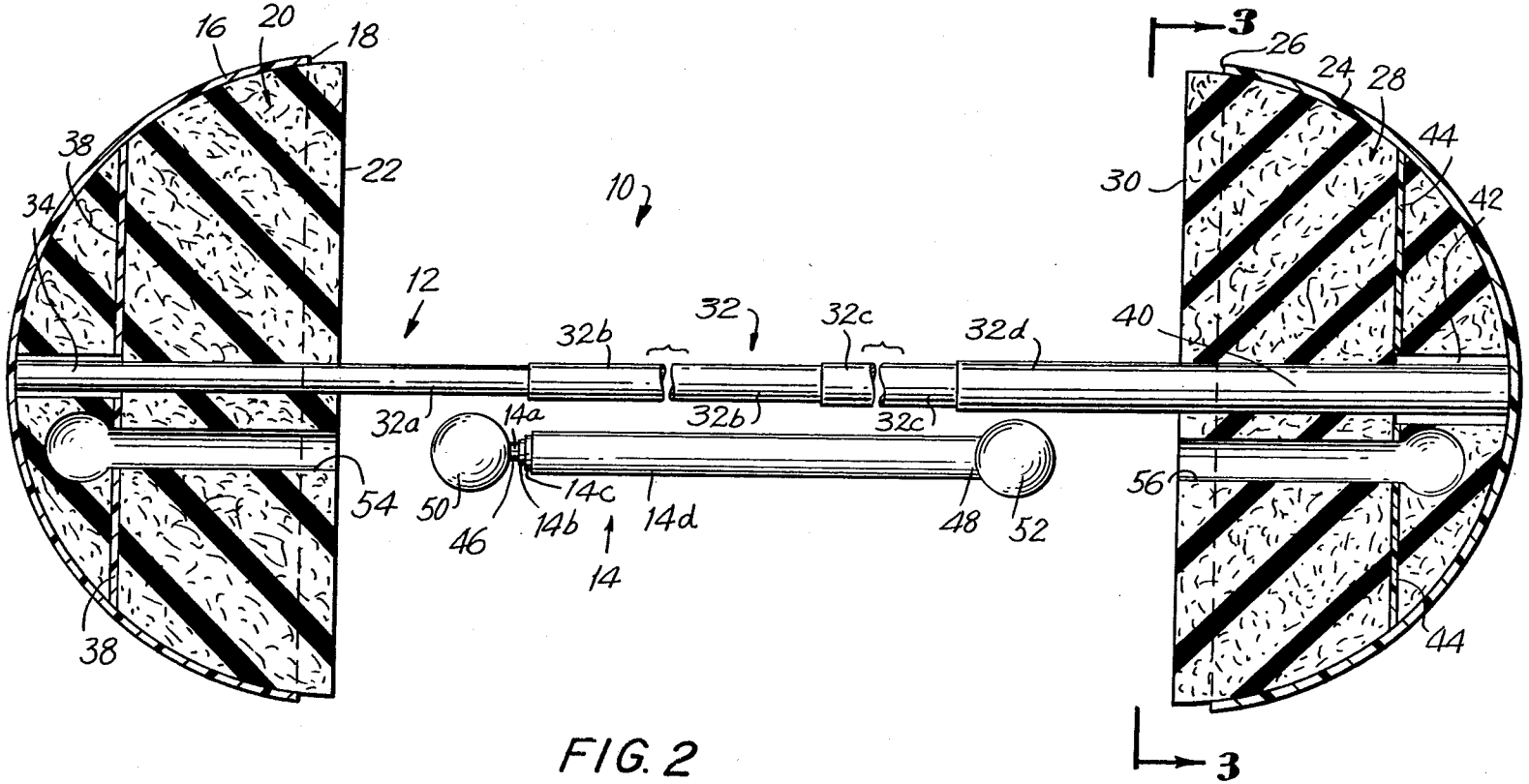
FIG. 2 is a cross-sectional view of the amusement device of FIG. 1, taken along line 2—2 thereof, and with the baton in its collapsed state.
Figure 3:
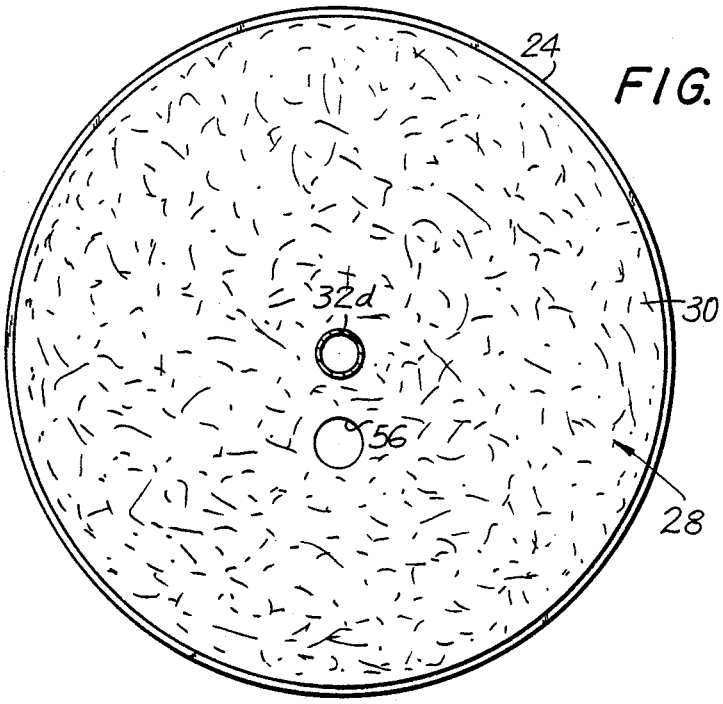
FIG. 3 is a cross-sectional view of the amusement device of FIG. 2, taken along line 3—3 thereof.

FIG. 2 shows an actual size amusement device 10 according to the present invention. As shown, dumbbell arrangement 12 includes a first thin half shell 16 preferably having a semi-spherical configuration, although the present invention is not limited to such configuration. First half shell 16 thereby has a circular open end 18. Preferably, first half shell 16 is made of a durable plastic material, such as a 1/32 inch thick, high impact plastic material.

A first filler material 20 is secured in first half shell 16 and extends partially out of open end 18 thereof by approximately ¼ to ½ inch, to define a first non-skid, planar playing surface 22 having a circular configuration. In this regard, it is important that first filler material 20 extends beyond open end 18. First filler material 20 can, for example, be a sponge rubber or foam material secured to the inside of first half shell 16 by an adhesive.

In like manner, dumbbell arrangement 12 includes a second thin half shell 24 also preferably having a semi-spherical configuration, although the present invention is not limited to such configuration. Second half shell 24 thereby has a circular open end 26. Preferably, second half shell 24 is also made of a durable plastic material, such as a 1/32 inch thick, high impact plastic material.

A second filler material 28 is secured in second half shell 24 and extends partially out of open end 26 thereof by approximately ¼ to ½ inch, to define a second non-skid, planar playing surface 30 having a circular configuration. For example, second filler material 28 can be a sponge rubber of foam material.

A connecting shaft 32 is provided for connecting first and second half shells 16 and 24 together. Specifically, connecting shaft 32 has a first end 34 that extends through first filler material 20 and is secured to the inside of first half shell 16. In this regard, first end 34 can be secured within a tube 36 secured radially to the inside center of first half shell 16. Tube 36, and thereby first end 34, is further secured by two support ribs 38 connecting tube 36 to another point on the inside surface of first half shell 16.

In like manner, connecting shaft 32 has a second end 40 that extends through second filler material 28 and is secured to the inside of second half shell 24 by means of a tube 42 secured radially to the inside center of second half shell 24. Tube 42, and thereby first end 40, is further secured by two support ribs 44 connecting tube 42 to another point on the inside surface of second half shell 24.

Figure 4:
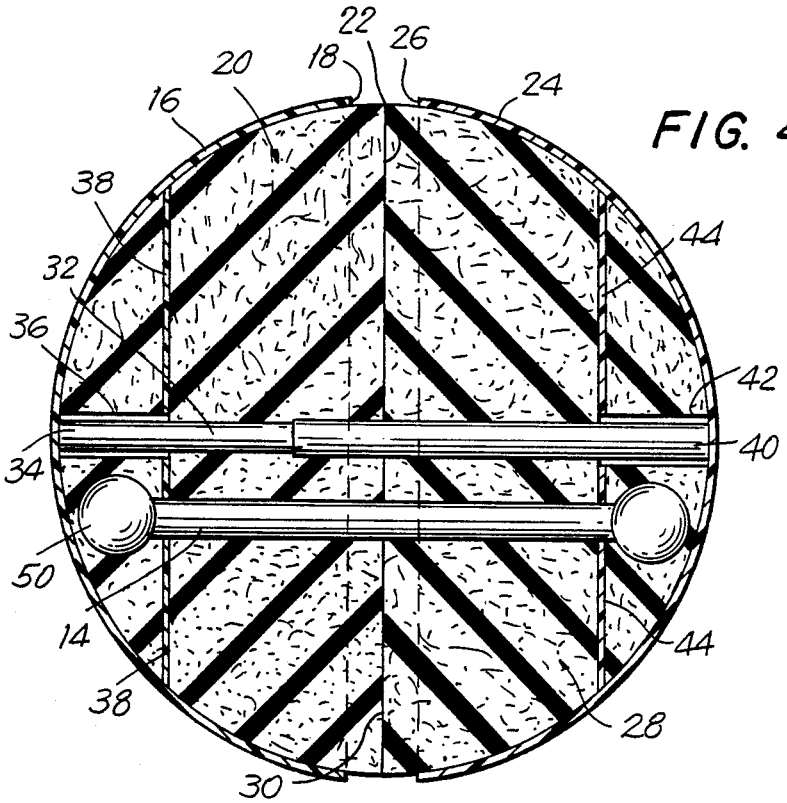
FIG. 4 is a cross-sectional view of the amusement device of FIG. 1 in its collapsed state.

In accordance with an aspect of the present invention connecting shaft 32 is of a telescoping nature, that is, being comprised of shaft portions **32*a*–32*d*, which telescope outwardly to the extended position shown in FIG. 2 or inwardly to the collapsed position shown in FIG. 4. When shaft portions 32*a*–32*d* are extended outwardly as shown in FIG. 2, connecting shaft 32 has a length sufficient to separate first and second half shells 16 and 24 in spaced apart relation with first and second non-skid playing surfaces 22 and 30 being in opposing, spaced relation. When shaft portions 32*a*–32*d* are collapsed, as shown in FIG. 4, shells 16 and 24 are moved toward each other, so that non-skid playing surfaces 22 and 30 are in contact, whereby dumbbell arrangement 12 can be stored in the form of a ball. It will be appreciated, however, that the present invention is not limited to such telescoping shaft 32. In other words, shaft 32 could be a rigid, non-telescoping shaft, such that dumbbell arrangement 12** does not collapse into a ball.

Amusement device 10, as aforementioned, also includes baton 14 for twirling dumbbell arrangement 12. Baton 14 has opposite ends 46 and 48, each provided with a ball 50 and 52, respectively, for easy grasping by the user, while the other non-grasped end engages against either of first and second non-skid playing surfaces 22 and 30 to twirl and throw dumbbell arrangement 12. In this regard, it is important that surfaces 22 and 30 be of the non-skid type, to enable such twirling and throwing.

In accordance with a preferred embodiment of the present invention, baton 14 is formed of a plurality of steel baton sections **14–14*d* which telescopically slide within each other. The actual size of baton 14 in the collapsed state is shown in FIG. 2, and baton 14 is shown in FIG. 1 in its extended state. When baton 14 is in its collapsed state, it can be stored within the collapsed dumbbell arrangement 12 shown in FIG. 4. In this regard, first and second filler materials 20 and 28 are provided with passages 54 and 56, respectively, through which baton 14 can extend. Thus, for example, ball 50 and end 46 can be inserted in passage 54, while ball 52 and end 48 can be inserted in passage 56, as shown in FIG. 4. Even where dumbbell 12 is of the non-collapsing type, as explained above, such passages 54 and 56 are still provided, since baton 14 can still be at least partially fit in one of the passages for storage. For example, ball 50 and end 46 can be inserted within passage 54, with ball 52 and end 48** extending outwardly therefrom.

Thus, with the present invention, a novel amusement device is provided including a dumbbell arrangement that can be twirled and thrown by a baton, wherein the dumbbell arrangement has non-skid surfaces against which the baton engages. Further, the dumbbell arrangement can be collapsed into a ball for carrying and storage, and the baton can be stored in the collapsed or extended dumbbell arrangement.

Having described specific preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined in the appended claims.

What is claimed is:

1. An amusement device comprising:

(a) a dumbbell arrangement including:

(i) a first thin half shell having a first open end;

(ii) a second thin half shell having a second open end;

(iii) a first filler material secured in the first half shell and extending partially out of the first open end to define a first non-skid playing surface;

(iv) a second filler material secured in the second half shell and extending partially out of the second open end to define a second non-skid playing surface; and (v) connecting shaft means for connecting the first and second half shells, the shaft means extending through the first and second filler materials and having opposite ends for connecting the first and second half shells, respectively, the shaft means having a length sufficient to separate the first and second half shells in spaced apart relation with the first and second playing surfaces in spaced, opposing relation; and (b) baton means for twirling the dumbbell arrangement, the baton means having opposite ends, one end of which is capable of being grasped by a person and the other end of which is capable of engaging against the first and second non-skid playing surfaces to twirl the dumbbell arrangement, (c) said dumbbell arrangement further comprising means to store said baton means when it is not in use.

2. An amusement device according to claim 1; wherein at least one of said first and second half shells have a semispherical configuration.

3. An amusement device according to claim 1; wherein said first and second half shells are made from a high impact plastic material.

4. An amusement device according to claim 1; wherein said first and second filler material extend out of said first and second shells, respectively, by approximately $\frac{1}{4}$ to $\frac{1}{2}$ inch.

5. An amusement device according to claim 1; wherein said shaft means includes a plurality of telescopically connected shaft portions, one of said shaft portions including one end of said shaft means which is connected to said first half shell and another one of said shaft portions including the opposite end of said shaft means which is connected to said second half shell.

6. An amusement device according to claim 5; wherein said shaft portions have lengths which provide that said first and second non-skid playing surfaces are in contact with each other when said shaft portions are collapsed on each other, to form said dumbbell arrangement in a collapsed ball configuration.

7. An amusement device according to claim 1; wherein said baton means includes a plurality of telescopically connected baton sections.

8. An amusement device comprising:

(a) a dumbbell arrangement including:

(i) a first thin semi-spherical half shell having a first open end;

(ii) a second thin semi-spherical half shell having a second open end;

(iii) a first filler material secured in the first half shell and extending partially out of the first open end to define a first non-skid playing surface;

(iv) a second filler material secured in the second half shell and extending partially out of the second open end to define a second non-skid playing surface;

(v) said first and second filler materials each have a passage therein; and (iv) connecting shaft means for connecting the first and second half shells, the shaft means extending through the first and second filler materials and having opposite ends for connecting the first and second half shells, respectively, said shaft means including a plurality of telescopically connected shaft portions, one of said shaft portions including one end of said shaft means which is connected to said first half shell and another one of said shaft portions including the opposite end of said shaft means which is connected to said second half shell, the shaft portions having lengths in an extended position which are sufficient to separate the first and second half shells in spaced apart relation with the first and second playing surfaces in spaced, opposing relation, and in a collapsed position which provide that said first and second non-skid playing surfaces are in contact so as to form said dumbbell arrangement in a collapsed ball configuration; and (b) baton means for twirling the dumbbell arrangement, the baton means having opposite ends, one of which is capable of being grasped by a person and the other of which is capable of engaging against the first and second non-skid playing surfaces to twirl the dumbbell arrangement, said baton means includes a plurality of telescopically connected baton sections wherein said baton means can be collapsed to fit within said passage when said dumbbell arrangement is in said collapsed ball configuration.

9. An amusement device according to claim 1; wherein said means to store said baton has a passage in at least one of said first or second filler materials.

10. An amusement device comprising:

(a) a dumbbell arrangement including:

(i) a first thin half shell having a first open end;

(ii) a second thin half shell having a second open end;

(iii) a first filler material secured in the first half shell and extending partially out of the first open end to define a first non-skid playing surface;

(iv) a second filler material secured in the second half shell and extending partially out of the second open end to define a second non-skid playing surface; and (v) connecting shaft means for connecting the first and second half shells, the shaft means extending through the first and second filler materials and having opposite ends for connecting the first and second half shells, respectively, the shaft means having a length sufficient to separate the first and second half shells in spaced apart relation with the first and second playing surfaces in spaced, opposing relation; and (b) baton means for twirling the dumbbell arrangement, the baton means having opposite ends, one of which is capable of being grasped by a person and the other of which is capable of engaging against the first and second non-skid playing surfaces to twirl the dumbbell arrangement, (c) said shaft means including a plurality of telescopically connected shaft portions, one of said shaft portions including one end of said shaft means which is connected to said first half shell and another one of said shaft portions including the opposite end of said shaft means which is connected to said second half shell, (d) said telescopically connected shaft portions being collapsible to permit said first and second half shells to be in facing arrangement to form a closed sphere for storage.

* * * * *